United States Patent [19]

Birdsong, Jr.

[11] 4,251,073

[45] Feb. 17, 1981

[54] APPARATUS AND METHOD FOR MANUFACTURING GAS-FILLED BALLS WITH PRECISION

[76] Inventor: William D. Birdsong, Jr., 2534 Wessex La., Chattanooga, Tenn. 37421

[21] Appl. No.: 918,718

[22] Filed: Jun. 26, 1978

[51] Int. Cl.[3] ..... B65B 31/04; A63B 41/12

[52] U.S. Cl. ..... 273/61 D; 53/88; 53/403

[58] Field of Search ..... 273/61 R, 61 D; 53/403, 53/88

[56] References Cited

U.S. PATENT DOCUMENTS

| | | | |
|---|---|---|---|
| 1,023,904 | 4/1912 | Wemple | 273/61 D |
| 1,630,110 | 5/1927 | Cole | 73/818 |
| 2,819,573 | 1/1958 | Whittington | 273/61 D X |
| 3,932,977 | 1/1976 | Ringler | 273/61 D X |
| 3,974,622 | 8/1976 | Stubblefield | 273/61 D X |
| 4,031,688 | 6/1977 | Wasserman | 273/61 D X |
| 4,114,350 | 9/1978 | Snyder | 273/61 D X |

*Primary Examiner*—George J. Marlo

*Attorney, Agent, or Firm*—Newton, Hopkins & Ormsby

[57] ABSTRACT

A tennis ball, racquet ball or other gas-filled ball is inflated with air or gas to such a degree that the ball will precisely balance a given applied force on the ball producing a given deflection of the ball. No attempt is made to achieve uniform internal pressure in inflated balls. The method instead attains a uniform and precise stress-strain relationship. The method of manufacturing produces substantially superior balls in terms of uniformity of play characteristics including bounce.

9 Claims, 5 Drawing Figures

Initially position compression means in contact with ball under zero force load.

Compress ball to selected deflection from initial zero load contact point.

Insert gaseous inflation and sealing needles into the injection cavity of ball.

Inject a sealing substance through the sealing needle into the ball cavity to form a puddle of sealing substance around both needles.

Inflate ball with gaseous medium until the force between the ball and compression means reaches a pre-selected force level.

Retract both needles.

Further compress ball to force sealing substance into the needle holes which were formed in the ball.

FIG 1

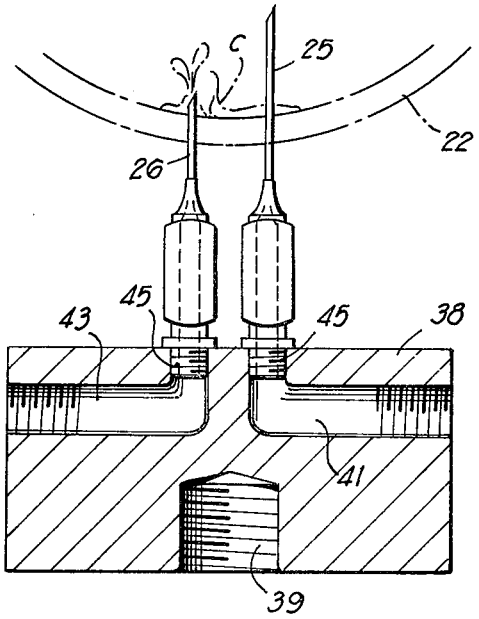

FIG 3

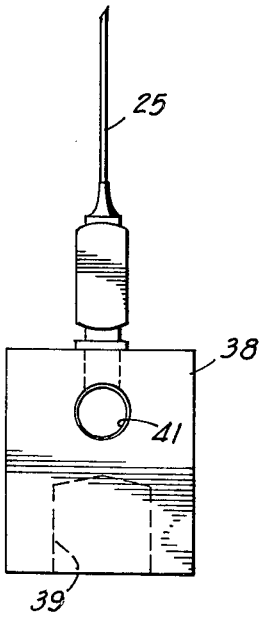

FIG 4

APPARATUS AND METHOD FOR MANUFACTURING GAS-FILLED BALLS WITH PRECISION

BACKGROUND OF THE INVENTION

In the prior art, tennis balls and the like are customarily inflated to a prescribed pressure and are tested in various ways, such as bounce testing, weight uniformity testing, and measuring ball deflection under a prescribed ball compressing force. Despite stringent efforts to inflate balls with great accuracy to predetermined degrees of pressure, followed by careful testing and pressure packaging, tennis balls and racquet balls frequently do not have the correct and uniform bounce and other play characteristics required for tournament play, particularly professional play. Heretofore, the prior art has not been able to deal with the problem of ball uniformity under known methods of manufacturing and testing with complete success despite strenuous efforts toward improvement. One reason for this is that there are too many hidden variables in the materials from which the balls are made, such as wall thickness, thickness uniformity and porosity for complete success ever to be achieved under prior art manufacturing methods.

To comply with the duty of disclosing known prior art under 37 C.F.R. 1.56, the following U.S. Pat. Nos. are made of record herein:

| | |
|---|---|
| 1,713,755 | 3,921,977 |
| 2,926,705 | 3,929,174 |
| 3,699,739 | 3,932,977 |
| 4,012,041. | |

In light of the above deficiencies of the prior art and ever-present variables in manufacturing which can never be completely controlled, the present invention involves a totally new approach to inflated ball manufacturing, wherein no effort is made to achieve uniform inflation pressure, but rather in the manufacturing process balls are inflated to such a degree that each ball will precisely resist or balance a given applied compressive force resulting in a given deflection of the ball. In other words, the improved process creates a perfectly uniform stress-strain relationship instead of a uniform inflation pressure in the balls, with the result that all of the balls so manufactured will possess the identical play characteristics, including bounce characteristics, regardless of variations in inflation pressure. Therefore, the improved method avoids the problems of the prior art caused by hidden variables in materials and processing steps and by one simple balanced deflection procedure, the quality of inflated balls produced far exceeds the quality of any known prior art production. The superior results are obtained with economy and simplicity of processing solely by utilizing readily available technology and commercial equipment.

Other features and advantages of the invention will become apparent during the course of the following description.

BRIEF DESCRIPTION OF THE DRAWINGS

FIG. 1 is a flow chart of the method.

FIG. 3 is an enlarged vertical section taken through a ball inflating and sealing needle holder.

FIG. 4 is an end elevation of the holder and needles.

DETAILED DESCRIPTION

Figure 2:
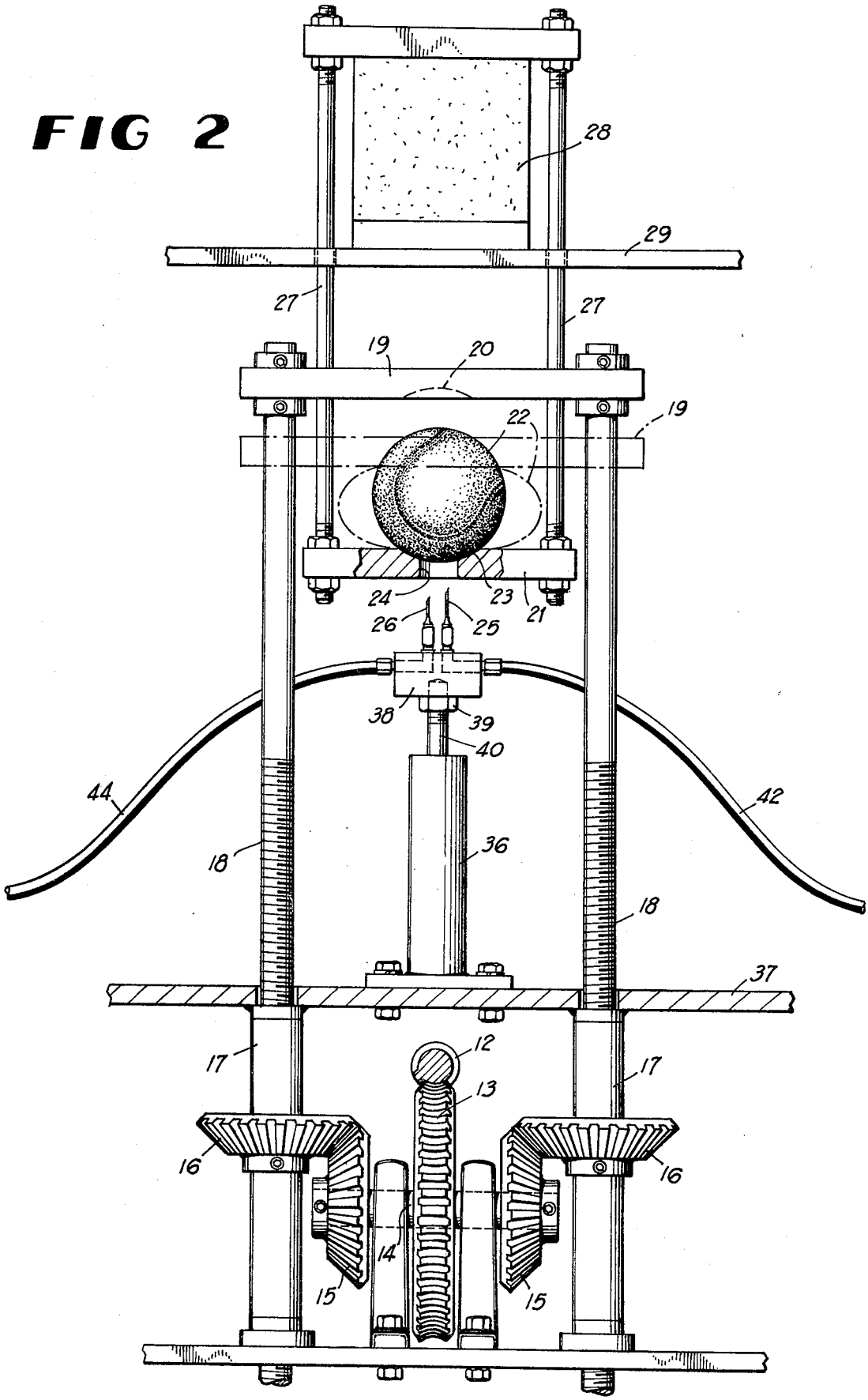
FIG. 2 is a side elevation, partly in section, of apparatus used in the practice of the method.

Referring to the drawings in detail wherein like numerals designate like parts, a drive motor 10 having a startstop button 11 is energized to drive a worm shaft 12 meshing with a worm gear 13 secured to a horizontal shaft 14 carrying a pair of bevel gears 15. The bevel gears 15 mesh with a pair of driven bevel gears 16 coupled with sleeve nuts 17 which drive vertical screw shafts 18 upwardly and downwardly with a crosshead 19 attached to the tops of screw shafts 18 and having a ball centering cavity 20 in its lower face. A rest plate 21 for a tennis ball 22 or the like has a central seating cavity or recess 23 for the ball and a central clearance opening 24 for ball inflating and sealing needles 25 and 26, to be further described. The rest plate 21 is supported on vertical suspension rods 27 connected at their tops to a conventional electronic load cell 28 having its bottom engaged with a stationary rigid horizontal support 29.

The apparatus thus far described, except for the needles 25 and 26, is essentially a modified Scott Model CRE Tester manufactured and sold by Scott Testers, Inc., 101 Blackstone St., Providence, R.I. 02901, a subsidiary of The Bendix Corporation. The load cell 28 of the tester apparatus is preferably a 0 to 200 pound unit.

Figure 5:
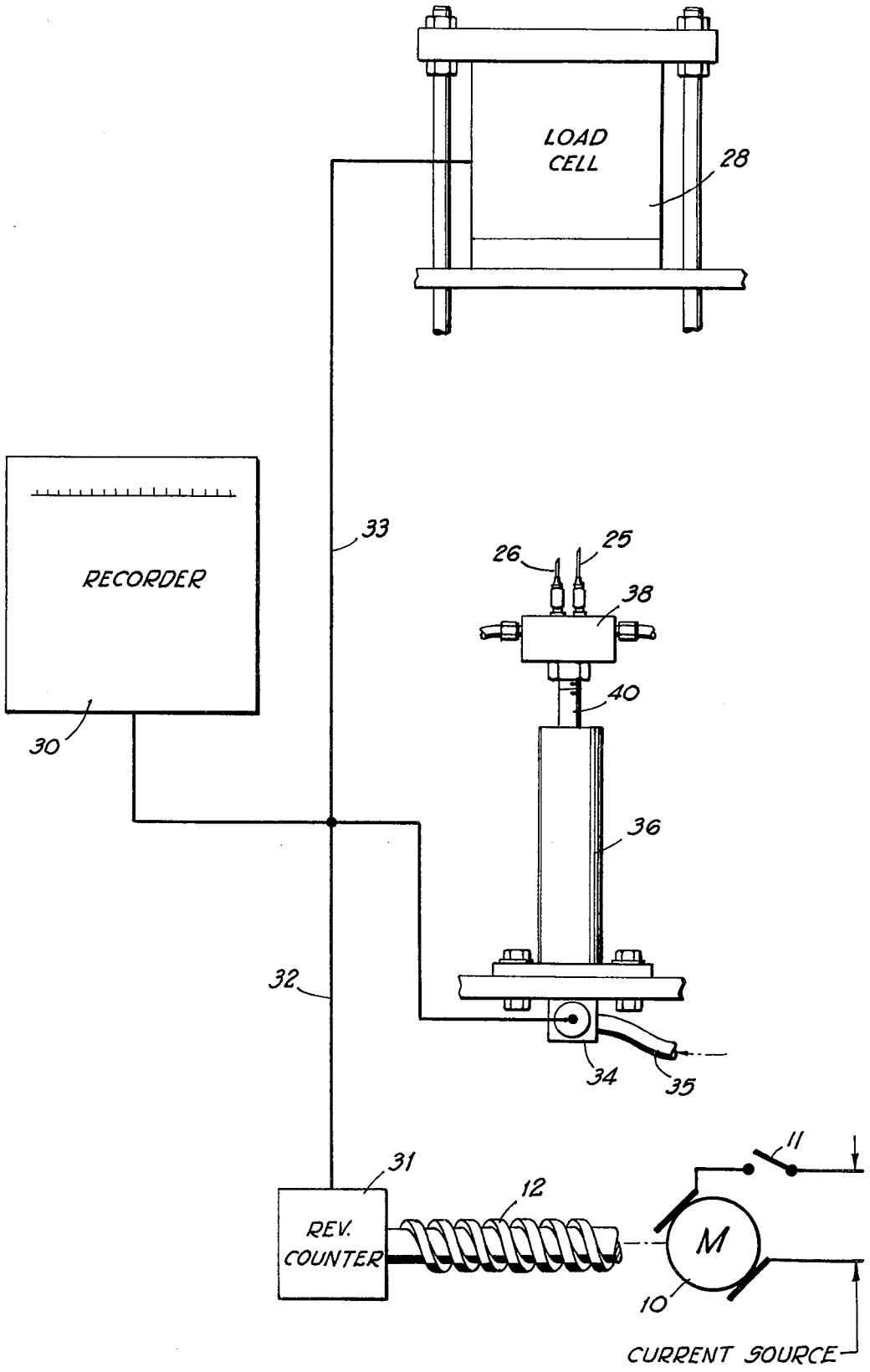
FIG. 5 is a schematic view showing components of the apparatus omitted for simplicity in FIG. 2.

As shown schematically in FIG. 5, the apparatus includes a recorder 30 which gives a visual read-out of the forces exerted through the load cell. The particular recorder 30, which is conventional, is manufactured and sold by The Bristol Company, Waterbury, Conn. 06720, Model No. ST-1PJ24570, Serial Number 67A-19264. This recorder apparatus is a standard component of the previously-identified Scott Tester, slightly modified to suit the purposes of this invention.

Referring to FIG. 5, the worm shaft 12 is coupled with a revolution counter 31 which is electrically coupled with the load cell 28 and recorder 30 by wires 32 and 33. Similarly, the load cell is electrically coupled through the wire 33 with a solenoid operated valve 34 connected in the fluid supply line 35 of an air cylinder 36 secured to a fixed support 37, FIG. 2, below and in alignment with the elements 20, 23 and 24. The two needles 25 and 26 are secured to a holder or block 38, in turn fixedly secured at 39 to the piston rod 40 of air cylinder 36.

Air for inflating the ball 22 is supplied to an internal passage 41 of the block 38 through a hose 42 having conventional controls, not shown, connected therewith. Cement for sealing the needle punctures produced by the two needles in each ball 22 is delivered to another passage 43 of the block 38 through a hose 44 also having conventional controls, not shown, associated therewith. The air and cement needles 25 and 26, FIG. 3, have threaded fittings 45 coupled to the block 38 in communication with passages 41 and 43, as illustrated.

The sealing cement C, FIG. 3, injected through needle 26 is a high quality rubber cement dispersed in a hydrocarbon solvent, such as TransWorld 3508 cement, marketed by TransWorld Adhesive and Chemical Company. Such cement possesses a No. 2 Zahn viscosity of 1.5–2.0 minutes.

The operation of the disclosed apparatus in the method of manufacturing balls of the type described is as follows:

A ball 22 constructed by conventional techniques and inflated to a relatively low pressure is placed on the seat 23 of rest plate 21. The motor 10 is started to turn the worm shaft 12 and power is transmitted through the worm and bevel gears to nuts 17 which drive the crosshead 19 and screw shaft 18 downwardly.

When the cavity 20 of the crosshead contacts the ball 22, the electronic load cell 28 delivers a signal to set a measuring device contained within the load cell to 0 pounds. This same electrical signal resets the revolution counter 31 to 0 revolutions.

When the shaft 12 has turned sufficient revolutions to cause the crosshead 19 to compress the ball 22 exactly one inch (or other specified distance) from the point of initial contact by the crosshead, the preset counter 31 stops the drive motor 10. The same electrical signal which stops the motor also operates the solenoid valve 34 to activate the piston of air cylinder 36 and this immediately forces the two needles 25 and 26 through the wall of the hollow ball 22, as shown in FIG. 3.

When the upward travel of block 38 causes it to engage a limit switch, on the rest plate 21, not shown, a timer switch, not shown, is activated to open a solenoid valve in the cement line 44. Pressurized cement of the type described flows through the passage 43 and needle 26 into the ball 22 to form a puddle around the two needle punctures. Approximately ½–1 cc. of cement per ball is used. When the cement has been injected, the cement solenoid valve, not shown, is closed automatically by a delay timer arresting the flow of cement to the needle.

The air inflation needle 25 which is continuously bleeding air inflates the ball 22 and increases the expansive force between the crosshead 19 and ball rest 21. When this increased force reaches 43 pounds (or any desired predetermined level) the compressed load cell 28 reacting to the force sends a signal to the air cylinder valve 34, retracting both needles 25 and 26 with their mounting block 38.

The same electrical signal reactivates the motor 10 starting up the worm shaft 12 whose rotation further compresses the ball 22 an additional increment such as ½ inch due to further downward movement of the crosshead 19. At the end of this further compression, the motor 10 reverses and returns the crosshead 19 to the original position shown in full lines in FIG. 2. This additional compression of the ball is essential to force the cement C into the needle puncture holes to permanently seal the same.

The entire cycle of operation is now repeated except that the needles 25 and 26 remain retracted from the ball and inactive. At the end of the one inch ball compression, the force applied to the load cell 28 can be read out as a digital display on the recorder 30 activated by the load cell. Should this reading be significantly lower than the predetermined force desired on the ball, that particular ball is rejected since it was not properly sealed, will lose air, and will not possess the proper physical play characteristics, such as bounce. If properly sealed and the desired force is verified on the recorder, the ball is processed into sealed cans at a positive pressure slightly higher than the ball inflation pressure. It is desirable that the canning of balls be done quickly after manufacturing, preferably in less than four hours after calibrating and sealing to prevent leaks of air through the natural porosity of the balls.

It can be seen that in the manufacturing process according to the invention no attempt is made to achieve uniform inflation pressure in each ball. Instead, each ball is inflated to a sufficient degree to exactly balance a given applied force causing a given deflection of the ball under this applied force. In effect, a precise stress-strain relationship is set up for the balls in the process of their manufacture. The invention possesses significant advantages over the prior art by providing tennis balls, racquet balls and other inflated hollow balls whose bounce and other play performance characteristics are highly consistent and uniform across large batches of balls despite the fact that their internal pressures may vary considerably in contrast to the prior art. The unique process of the invention compensates for or cancels out the inherent variables which exist and are beyond specific control.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a method of manufacturing inflated hollow balls to achieve highly uniform performance characteristics for the balls, the steps of engaging each ball with compression means under substantially zero loading, compressing each ball by means of said compression means to a preselected degree of ball compression and deflection, inserting gaseous inflation and sealant injection needles through the wall of each ball while the ball is held under said degree of compression and deflection, injecting a flowable sealant through said sealant injection needle into the ball to form a puddle of sealant around both needles, inflating each ball with a gaseous medium through the inflation needle while the ball is held under said degree of compression and deflection until the inflation pressure in the ball exactly counterbalances the force required to produce said degree of ball compression and deflection, retracting both needles from the ball, and further compressing each ball to force said sealant into the puncture holes produced by said needles.

2. In a method of manufacturing inflated game balls having highly uniform performance characteristics, the steps of supporting a ball, compressing the supported ball to a predetermined degree of compression, inflating the ball while it is under such degree of compression sufficiently to cause the ball to exactly counterbalance the applied force on it producing said degree of compression, discontinuing the inflation of the ball at that point and sealing it against escape of the inflating fluid.

3. In a method of manufacturing inflated hollow balls as defined in claim 2, and transmitting a force necessary to cause said predetermined degree of compression through a load cell whereby the load cell may produce an electrical signal to control the operation of ball compressing and ball inflating and sealing means.

4. In a method of manufacturing inflated hollow balls as defined in claim 3, and visually measuring the force necessary to produce said degree of compression of the balls on a recording means activated by a signal from said load cell.

5. An inflated game ball manufactured by the method in claim 2.

6. A method as in claim 2 wherein the sealing is accomplished by injecting a sealing substance into the ball prior to inflating it and while it is under compression.

7. In a method of manufacturing inflated game balls as defined in claim 6, and further compressing the ball following the injecting into it of said sealing substance to force the sealing substance into puncture holes in the ball caused by inflating and injecting of said sealing substance.

8. In a method of manufacturing inflated game balls as defined in claim 7, and again compressing the ball to said predetermined degree of compression and measuring the force necessary to cause the second compression of the ball to said predetermined degree for the purpose of determining whether the applied force is within allowable tolerance limits so that processed balls can be accepted or rejected.

9. In a method of manufacturing inflated game balls as defined in claim 8, and visually measuring the sufficiency or insufficiency of the force necessary to cause said second compression to said predetermined degree on a recording device.

* * * * *